United States Patent [19]

Page

[11] Patent Number: 4,766,943

[45] **Date of Patent: * Aug. 30, 1988**

[54] EXPENDABLE DIE CASTING SAND CORE

[75] Inventor: Enno H. Page, San Lorenzo, Calif.

[73] Assignee: Farley Metals, Inc., Chicago, Ill.

[ * ] Notice: The portion of the term of this patent subsequent to Nov. 8, 2000 has been disclaimed.

[21] Appl. No.: 496,978

[22] Filed: Oct. 3, 1983

Related U.S. Application Data

[63] Continuation of Ser. No. 290,447, Aug. 6, 1981, Pat. No. 4,413,666, which is a continuation-in-part of Ser. No. 80,833, Oct. 1, 1979, abandoned.

[51] Int. Cl.[4] ..... B22C 3/00; B22C 1/22; B22C 9/10

[52] U.S. Cl. ..... 164/72; 164/113; 164/138; 164/369; 164/527; 427/134; 523/139; 523/148

[58] Field of Search ..... 164/72, 113, 138, 369, 164/527; 427/134; 523/139, 148

[56] References Cited

U.S. PATENT DOCUMENTS

| | | | |
|---|---|---|---|
| 3,401,735 | 9/1968 | Pursall | 427/134 X |
| 3,639,654 | 2/1972 | Robins | 164/16 X |
| 3,879,339 | 4/1975 | Richard | 164/16 X |
| 3,922,245 | 11/1975 | Skubon et al. | 427/134 X |
| 4,001,468 | 1/1977 | Skubon et al. | 427/134 |
| 4,096,293 | 6/1978 | Skubon et al. | 427/134 |
| 4,127,157 | 11/1978 | Gardikes et al. | 164/113 X |
| 4,194,915 | 3/1980 | Perkins | 427/134 X |

FOREIGN PATENT DOCUMENTS 46-942 1/1971 Japan .

*Primary Examiner*—Nicholas P. Godici
*Assistant Examiner*—J. Reed Batten, Jr.
*Attorney, Agent, or Firm*—Hugh Adam Kirk

[57] ABSTRACT

Sand cores containing an acid curable binding agent are used in the production of die castings having undercut regions because of the favorable combination of shake-out properties, resistance to washout, and resistance to surface penetration.

18 Claims, No Drawings

EXPENDABLE DIE CASTING SAND CORE

This application is a continuation of application Ser. No. 290,447 filed Aug. 6, 1981, now U.S. Pat. No. 4,413,666 issued Nov. 8, 1983, which is a continuation-in-part of application Ser. No. 80,833 filed Oct. 1, 1979, now abandoned.

The invention relates to the art of die casting such metals as aluminum, zinc, magnesium, copper, iron and their alloys and to a solution to a long standing problem therein; i.e., the lack of a commercially feasible die casting technique to produce castings having undercut regions. Traditional die casting requires molds or dies which are able to withstand the high temperature and pressures to which they are subjected. Such pressures exceed several thousand psia. Die casting as used throughout this application defines a casting made under such pressures as opposed to gravity fed castings which are made under pressures typically not exceeding about 30 psia.

Die castings differ from sand castings, gravity permanent mold castings and low pressure permanent mold castings in alloy chemistry, metallographic structure and surface appearance and features. Typically, the chemical compositions of alloys used in die casting distinctly differ from those used in sand casting or permanent mold casting. Analysis of the casting generally reveals the alloy differences. Die castings have a finer metallurgical structure due to the rapid solidification of metal forced against the colder die steel under high pressure, with an extremely fine structure at the surface of the casting where the metal receives an extra chill. Grain size, dendrite size and spacing, eutectic particle size and form, and second phase particles of a die casting differ from that of a sand or permanent mold casting. Standard metallographic examination wil thus distinguish these differences. Surface appearance and feature differences include greater surface smoothness, greater surface detail, sharper corners, thinner ribs, smaller holes, finer letters, thinner wall sections and characteristic die casting features such as heat check marks, sharper parting line flash and sharper ejector pin bosses.

Ferrous materials are commonly used for die casting molds. Because these die materials are not collapsible, complex undercuts and reliefs are not possible since such casting could not be removed from the mold.

Other casting techniques use sand and semipermanent mold casting and expendable or disposable cores to produce castings having undercuts but only in gravity fed casting methods which are accomplished at low pressures.

One expendable sand core useful in foundry art is disclosed in Richard U.S. Pat. No. 3,879,339 includes an acid curable resin, an oxidizing agent and sand. This patent discloses manufacture of solid or hollow bodies useful for coring or for molding castings in foundry. The term foundry is typically limited to gravity fed-low pressure casting methods.

Binding systems of the boronated aluminum phosphate type have been proposed for use in making expendable sand cores for die casting. Such systems are illustrated in Gardikes et al U.S. Pat. No. 4,127,157, but such systems produce cores having lower strength, especially immediately following coremaking than is desirable. The boronated aluminum phosphate binding systems also have limited blowability and thus desired density levels in the cores cannot be obtained.

Another binder useful in foundry casting includes phenolic isocyanates, a sand binder of the urethane no-bake family which is cured with triethyl amine gas. The cores comprised of this binder and sand withstand the pressure of die casting. However, shakeout is unsatisfactory because removal of the core was nearly impossible. Another phenolic isocyanate binder useful in foundry casting was found to be very sticky thus making shakeout difficult and small intricate cores unsatisfactory.

A further foundry art binder is phosphate inorganic which is self setting. This binder has poor moisture resistance, set time and shelf life and therefore is not useful in commercial die casting processes.

A still further foundry art binder is sodium silicate inorganic, cured with $CO_2$. However when used in the die casting area, the strength of cores using this binder is low and the shakeout poor.

A major problem in the development of a satisfactory expendable core for use in die casting has been the inability of a single core/binder system to simultaneously meet four primary core characteristics. They are good shakeout, good washout resistance, freedom from surface penetration, and core strength.

Good shakeout is necessary to facilitate core removal from the casting. Washout resistance is the ability of the core to withstand erosion from the high metal velocities that occur during die casting. Not only does washout adversely affect the tolerances on the finished part but the sand physically removed from the core becomes embedded in the casting. Surface penetration is caused by the combination of high heat and pressure that breaks down the core surface and permits the metal to penetrate between the sand grains thus causing a sand/-metal mixture interface at the surface of the casting. This condition is extremely detrimental to subsequent machining. Moreover, should the sand become separated from the surface after component installation, damage to related parts, such as automobile parts, could result. High strength for cores is desirable in that the cores are more resistant to breakage during handling and are also more resistant to breakage during the rigors of the casting. The core of this invention is considered to be capable of attaining the requisite balance of the four properties.

SUMMARY OF THE INVENTION

It has been discovered that expendable sand cores can be used to produce die castings having undercut regions provided that a core consisting essentially of sand and binding agent, the agent comprising from about 0.25 wt % to about 5 wt % of the sand, the binding agent consisting essentially of an acid curable resin and an oxidizing agent, the oxidizing agent comprising from about 20 wt % to about 70 wt % of the resin is used. The lower limit is required to provide sufficient core strength to withstand handling while the upper limit should not be exceeded due to blowing problems during coremaking caused by a lack of uniform density relative to variations in sand flow and unacceptable decreases in shakeout efficiency.

Additionally, it has been discovered that sand cores of the foregoing compositions are beneficially improved by coating with composition of a suspending agent, refractory material, a binding agent and a liquid vehicle.

In a second aspect, this invention comprises a method of forming a foundry core or mold using the foregoing binder composition and optionally coating the core with the foregoing coating composition.

In a third aspect, this invention comprises a mold and expendable core of the foregoing binder composition preferably of the coating composition.

PREFERRED EMBODIMENTS

It is preferred in the present to employ between about 1% to 2% binding agent by weight of sand. Heavier foundry sands such as zircon require less binder, i.e., preferably between about 0.5% and 1.0%. Use of other common foundry sands having different densities than the above mentioned sands is within the scope of the invention. Such other sands would preferably require the use of binder amounts consistent with density.

The choice of a specific binder level will be dependent upon core shape, core thickness, complexity, the manner in which the core is secured within the casting die, and casting conditions. The binder, mixed with foundry sand and an appropriate amount of oxidizing agent forms the core.

Suitable acid curable resin binding systems include but are not limited to urea/formaldehyde, phenol/formaldehyde, furane, and copolymers of such resins. It is preferred to use furane because this system is more resistant to distortion immediately following coremaking than the other systems. It is also possible to use copolymers of these resins with epoxidized compounds or with unsaturated compounds.

An oxidizing agent should be present in the binding system in quantities ranging from about 20% to 70%, based upon weight of the resin. Amounts from 30% to 50% are preferred to ensure complete curing. The oxidizing agent functions to react with gaseous sulphur dioxide to form sulphuric acid, which, in turn, cures the resin. Suitable oxidizing agents include but are not limited to methyl ethyl ketone peroxide, hydroperoxide, hydroxyhydroperoxide, chlorate, perchlorate, chlorite, hydrochloride, perbenzoate, metal oxide, permanganate, monoperiphthalic acid, and hydrogen peroxide. Preferably, the oxidizing agent is methyl ethyl ketone peroxide. Such oxidizing agents are normally added as a liquid to the resin to facilitate mixing although the use of solid or gaseous agents is not outside the scope of this invention.

The binder system preferably contains about 1% to 10% by weight of resin of a silane such as gamma-aminopropyltriethoxysilane. Such additions function to strengthen the core.

Following its preparation, the core may be preferably coated to further improve performance with respect to washout and surface penetration. Suitable core coatings generally comprise a suspending agent, a refractory material, a binding agent, and a liquid vehicle. A core coating is applied by brushing, dipping, spraying or an equivalent method. Once the coating is dry, the core is placed into a die located on a casting machine.

Suspending agents are usually clay or clay derivatives. These materials should be present in amounts sufficient to perform the function of maintaining the refractory material in suspension. Based upon total solids weight, such agents may be present in amounts ranging from about 4% to 30%.

Typical particulate refractory materials that are useful in the coating formulation include but are not limited to graphite, coke, silica, aluminum oxide, magnesium, oxide, zircon, mica, talc and calcium aluminate. The calcium aluminate is preferred having an average particle size of 20 to 25 microns and having no particle size greater than 40 to about 70 microns. These materials are present in amounts generally ranging from about 60% to 95% based upon total solids weight.

Suitable binding agents for the casing composition include thermoplastic resins, vinyl toluene/butadiene copolymer, styrene/butadiene copolymer, vinyl toluene/arcylate copolymer, styrene/acetylene copolymers, or acrylate homopolymers. Binding agents useful in the practice of the invention generally comprise from about 1% to 10% by total solids weight of the coating composition.

The binding and suspending agents should be compatible with the particular liquid vehicle which may be an organic liquid such as but not limited to an organic liquid solvent having a kauri-butanol value of at least 36, such as liquid 1,1,1-trichloroethane. The liquid vehicle should be included in an amount which is effective to obtain the necessary viscosity to control coating thickness and uniformity, ranging from 0 to 35 weight percent.

A preferred core coating comprises, based upon total solids weight, from 4% to 30% of an amine treated bentonite suspending agent, from 1% to 10% of an thermoplastic resin binding agent, and from 60% to 95% of a refractory such as silica or the like.

The following example illustrates an embodiment of the invention:

An aluminum alloy was die cast using a core containing 97.90 wt % silica foundry sand (AFS Fineness No. 65), furane, 1.47 wt % and methyl ethyl ketone peroxide 0.59 wt %, and 0.04 wt. % silane. A core coating as set forth previously was applied to the core prior to die casting. Core strength was good. Good shakeout properties were noted following mechanical separation of the core from the casting upon cooling to ambient temperature. The casting exhibited good resistance to surface penetration and washout resistance was good.

I claim:

1. A method for forming a die casting having an undercut region comprising:

(A) forming a die casting die having a casting surface that includes at least one expendable sand core that forms said undercut region, said sand core having good shake-out properties, good washout resistance, freedom from surface penetration, good shelf life, and a high core strength to withstand pressures in excess of several thousand psi, said core consisting essentially of:

(a) sand, and (b) a binding agent comprising between about 1 and about 2% by weight of said sand, said binding agent consisting essentially of an acid curable resin and as oxidizing agent, said oxidizing agent comprising between about 20 and about 70% by weight of said resin, and a silane, said core being cured with sulphur dioxide; and (c) a coating on said cured core consisting essentially of:

(1) between about 4 and about 30% by weight of a suspending agent comprising a clay, (2) between about 60 and about 95% by weight of a particulate refractory material selected from the group consisting of graphite, coke, silica, aluminum oxide, magnesium oxide, zircon, mico, talc, and calcium aluminate particles, and (3) between about 1 and about 10% by weight of a binding agent comprising an organic thermoplastic resin;

(B) injecting molten metal into said die casting die, (C) permitting said injected molten metal to solidify to form said die casting having said undercut region, and (D) removing said die casting from said die, and (E) separating said expendable core from said undercut region within said die casting.

2. A method according to claim 1 wherein said binding agent for said sand core includes between about 1 and 10% by weight of sand silane.

3. A method according to claim 1 wherein said silane comprises gamma-amino-propyltriethoxysilane.

4. A method according to claim 1 wherein said acid curable resin comprises furane.

5. A method according to claim 1 wherein said oxidizing agent is selected from the group consisting of methyl ethyl ketone peroxide, hydroperoxide, hydroxyhydroperoxide, and hydrogen peroxide.

6. A method according to claim 5 wherein said oxidizing agent comprises methyl ethyl ketone peroxide.

7. An expendable sand core having good shake-out properties, good washout resistance, freedom from surface penetration, good shelf life, and a high core strength to withstand pressures in excess of several thousand psi, said core adapted to define an undercut region in a die casting comprising:

(A) a base of:

(a) sand, and (b) a binding agent comprising between about 1 and about 2% of weight of said sand, said binding agent consisting essentially of an acid curable resin and an oxidizing agent, said oxidizing agent comprising between about 20 and about 70% by weight of said resin, and a silane, said base being cured with sulphur dioxide, and (B) a coating on said base consisting essentially of:

(a) between about 4 and about 30% by weight of a suspending agent comprising a clay, (b) between about 60 and about 95% weight of a particulate refractory material selected from the group consisting of graphite, coke, silica, aluminum oxide, magnesium oxide, zircon, mica, talc, and calcium aluminate particles, and (c) between about 1 and about 10% by weight of a binding agent comprising an organic thermoplastic resin.

8. A sand core according to claim 7 wherein said binding agent for said sand core includes between about 1 and 10% by weight of said silane.

9. A sand core according to claim 7 wherein said silane comprises gamma-amino-propyltriethoxysilane.

10. A sand core according to claim 7 wherein said acid curable resin comprises furane.

11. A sand core according to claim 7 wherein said oxidizing agent is selected from the group consisting of methyl ethyl ketone peroxide, hydroperoxide, hydroxyhydroperoxide, and hydrogen peroxide.

12. A sand core according to claim 11 wherein said oxidizing agent comprises methyl ethyl ketone peroxide.

13. A method of forming a die casting having an undercut region from a die casting die having a casting surface that includes at least one expendable sand core that forms said undercut region, said core having good shake-out properties, a good washout resistance, freedom from surface penetration, a good shelf life, and a high core strength to withstand pressures in excess of several thousand psi, said method comprising:

(A) forming said core consisting essentially of:

(a) sand, and (b) a binding agent comprising between about 1 and about 2% by weight of said sand, said binding agent consisting essentially of an acid curable resin and an oxidizing agent, said oxidizing agent comprising between about 20 and about 70% by weight of said resin, and a silane, said core being cured with sulphur dioxide; and (c) a coating on said cured core consisting essentially of:

(a) between about 4% and about 30% by weight of a suspending agent comprising a clay.

(b) between about 60% and about 95% by weight of a particulate refractory material selected from the group consisting of graphite, coke, silica, aluminum oxide, magnesium oxide, zircon, mica, talc, and calcium aluminate particles, and (c) between about 1% and about 10% by weight of a binding agent comprising an organic thermoplastic resin;

(B) placing said formed core in said die casting die;

(C) injecting molten metal into said die casting die;

(D) permitting said injected molten metal to solidify to form said die casting having said undercut region;

(E) removing said die casting from said die; and (F) separating said expendable core from said undercut region within said die casting.

14. A method according to claim 13 wherein said binding agent for said sand core includes between about 1 and 10% by weight of said silane.

15. A method according to claim 13 wherein said silane comprises gamma-amino-propyltriethoxysilane.

16. A method according to claim 13 wherein said acid curable resin comprises furane.

17. A method according to claim 13 wherein said oxidizing agent is selected from the group consisting of methyl ethyl ketone peroxide, hydroperoxide, hydroxyphydroperoxide, and hydrogen peroxide.

18. A method according to claim 17 wherein said oxidizing agent comprises methyl ethyl ketone peroxide.

* * * * *